US012806492B2

(12) United States Patent
Magaletta

(10) Patent No.: US 12,806,492 B2
(45) Date of Patent: Nov. 24, 2026

(54) GOLF GRIP TOOL

(71) Applicant: John Magaletta, New Paltz, NY (US)

(72) Inventor: John Magaletta, New Paltz, NY (US)

( * ) Notice: Subject to any disclaimer, the term of this patent is extended or adjusted under 35 U.S.C. 154(b) by 0 days.

(21) Appl. No.: 19/037,834

(22) Filed: Jan. 27, 2025

(65) Prior Publication Data

US 2026/0216576 A1 Jul. 30, 2026

(51) Int. Cl.
*A63B 60/10* (2015.01)
*A63B 69/36* (2006.01)

(52) U.S. Cl.
CPC ..... *A63B 60/10* (2015.10); *A63B 69/3632* (2013.01); *A63B 2225/74* (2020.08)

(58) Field of Classification Search
CPC ..... A63B 60/10; A63B 60/12; A63B 69/3632
See application file for complete search history.

(56) References Cited

U.S. PATENT DOCUMENTS 5,217,380 A 6/1993 Martinet
6,716,034 B2 * 4/2004 Casanova, Jr. ..... A63B 69/36 473/202
7,022,025 B1 * 4/2006 Cascerceri ..... A63B 53/14 473/549
7,607,990 B1 * 10/2009 Slane ..... A63B 69/36 473/301
7,637,821 B2 * 12/2009 Johnson ..... A63B 69/3685 473/202
8,062,147 B2 * 11/2011 Johnson ..... A63B 53/14 473/303
8,801,530 B2 * 8/2014 Beck ..... A63B 71/0622 473/201
10,052,538 B2 * 8/2018 Davis ..... A63B 60/10
10,821,343 B1 * 11/2020 Chavan ..... A63B 53/14
2007/0298899 A1 12/2007 Wang
2008/0102974 A1 * 5/2008 Nam ..... A63B 60/00 473/302
2009/0170641 A1 * 7/2009 Qin ..... G09B 19/00 473/422
2010/0151973 A1 6/2010 Brunton et al.
2010/0167829 A1 * 7/2010 Rhodes ..... A63B 69/3632 473/226
2010/0184530 A1 * 7/2010 Johnson ..... A63B 69/3685 473/409
2018/0117432 A1 * 5/2018 Aliberti ..... A63B 53/14

FOREIGN PATENT DOCUMENTS

JP 2024059563 A * 5/2024 ..... A63B 53/047
KR 20210010727 A * 1/2021 ..... A63B 60/10

* cited by examiner

*Primary Examiner* — Peter J Iannuzzi
(74) *Attorney, Agent, or Firm* — Saile Ackerman LLC; Stephen B Ackerman

(57) ABSTRACT

A golf grip tool is described, comprising a cylindrical device tapered, from a larger butt end to a narrower tip end. The tool provides placement aids so that the fingers may be placed on the club closely to where they need to be. The golf grip tool provides graphics to highlight and identify areas of the golf grip tool that are acceptable places for the placement of the fingers of both hands, establishing the orientation of the tool utilizing a center line arrow on the topside of the tool. The tool ensures the correct placement of the pinky at a right angle (or very near) to that of the tool and provides a light or spring to correctly establish the heel pad position, giving immediate feedback to the user.

10 Claims, 10 Drawing Sheets

GOLF GRIP TOOL

BACKGROUND

Field

The present disclosure relates generally to teaching a proper way to grip a golf club, through the correct positioning of the hands on the club.

BACKGROUND

Proper placement of the top hand (the left hand for right-handed golfers, and the right hand for left-handed golfers) in a golf grip is the most critical element of the grip. Most players will not learn a proper grip without taking lessons from a qualified instructor. Unfortunately, many players will not take a lesson, let alone the number of lessons necessary to ensure that they have the correct grip right.

Some players resort to reading instruction books, but illustrations and words are often not effective. Some golfers ask friends for grip advice, and others might not care at all if they are using a correct grip.

There are training aids available to help achieve proper positioning of the hands on the club. They range from very sophisticated to quite simple. Some are molded devices that are slid over an existing grip, or attached to a golf club by clipping it on. Generally, these attempt to conform one's hands to the device in the hopes that one remembers and can place one's hands in the proper position when the device is removed. Transference to usage during actual play is not guaranteed, and the player receives no feedback and has very little flexibility. There is also a molded rubber grip on the market that is installed on an existing club. It attempts to achieve a similar function, hoping a manufactured conformity of the molding shape will carry over to a grip on an actual golf club.

SUMMARY

The present disclosure seeks to provide a golf grip tool designed to be as close as possible in size and shape to a regulation U.S.G.A (United States Golf Association) golf grip.

The present disclosure also seeks to provide placement aids so that the fingers can be placed on the club close to where they need to be, in part by utilizing graphics on the grip tool of the disclosure.

The present disclosure also seeks to provide, highlight, and identify areas of the golf grip that are acceptable places for the placement of the fingers of both hands, establishing the orientation utilizing a center line arrow on the topside of the tool, facing away from a user's body.

Accordingly, it is an object of one or more embodiments of the present disclosure to insure the correct placement of the pinky of the left hand (for a right-handed golfer) at a right angle (or very near) to that of the tool.

It is a further object of the disclosure to provide a hand placement indicator, for insuring proper positioning of the top hand (the left hand heel pad for a right-handed golfer) on or very near the top center of the grip.

The above and other objects of the present disclosure may be accomplished in the following manner. A golf grip tool is disclosed, comprising a cylindrical device tapered from a larger butt end to a narrower tip end, where the tip end has an extension from a grip portion to simulate an upper end of a golf club shaft. The golf grip tool also comprises a finger placement spline, running approximately the length of the golf grip tool and mounted on its underside, and a hand placement indicator, configured to be pushed down with the pressure of a hand heel pad. The golf grip tool also comprises a pinky stop, comprising a protrusion that encircles approximately half of the grip tool, starting near to where the spline ends at the butt end, located at a right angle to the grip tool, and traveling in a half circle around the underside of the grip tool.

The objects of the disclosure are further achieved by providing a club head that can be added to the golf grip tool to create a tool that can stand up on a desk or on any hard, flat surface, that would encompass aim and alignment, as well as relationship of the grip to the club face.

The objects of the disclosure are further achieved by providing hand placement indicators including an electric light button or spring embedded in the tool at the butt end, configured to be pushed down with the pressure of a hand heel pad.

The object of this disclosure includes its variants, and its alternative embodiments, independently of its applications or processes it may be applied to.

BRIEF DESCRIPTION OF THE DRAWINGS

The present disclosure will be more clearly understood from the following description taken in conjunction with the accompanying drawings in which like reference numerals designate similar or corresponding elements, regions, and portions and in which.

DETAILED DESCRIPTION

Figure 1A:
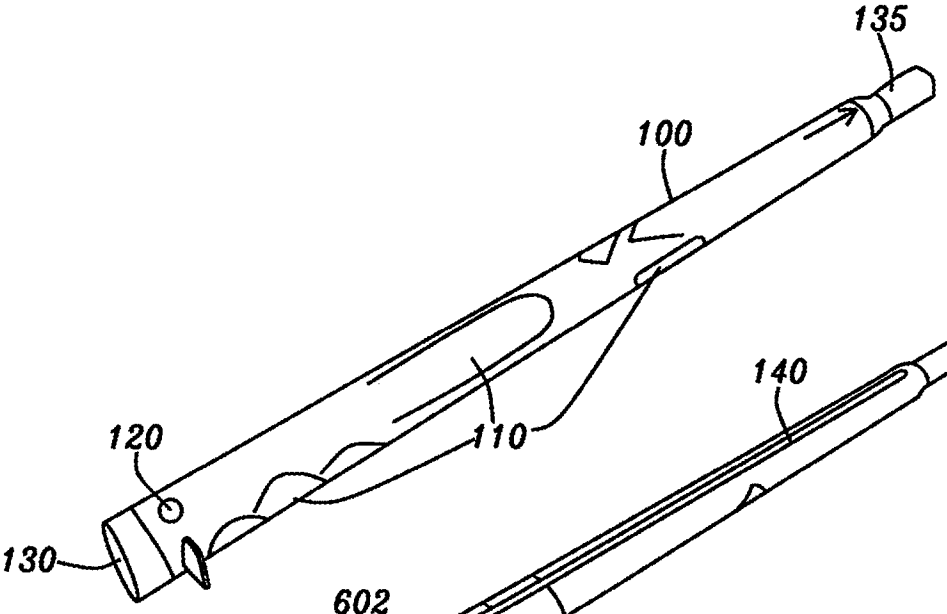
FIGS. 1A-1D show perspective views, as well as topside and underside views, of the present disclosure.
Figure 1B:
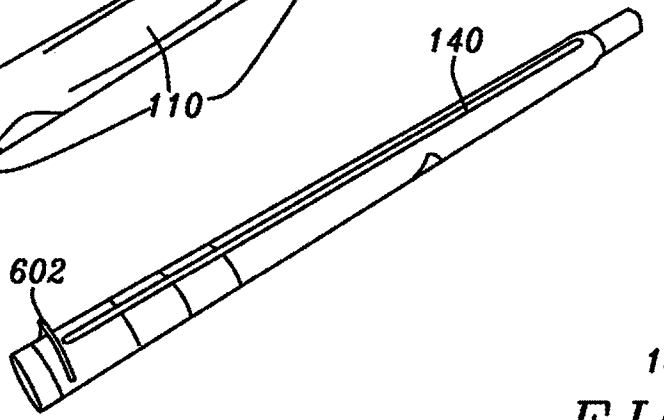
Figure 1C:
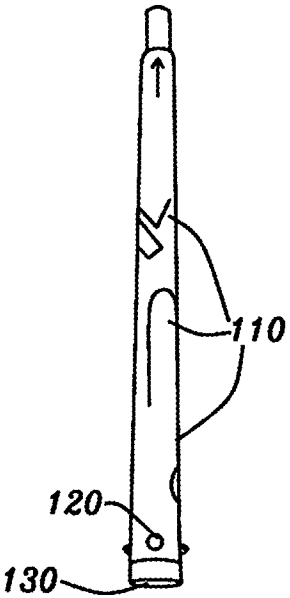
Figure 1D:
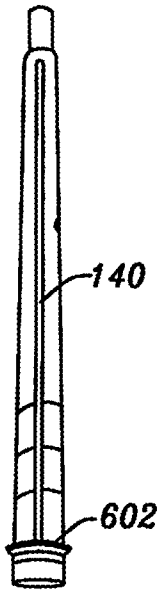

Most golfers do not have a good "grip", that is, proper positioning of their hands on the upper "grip" portion of a golf club, and seek instruction from professionals or instruction books, but often don't take enough lessons or receive enough instruction for proper, actual application. Current golf grip training aids most commonly rely on a molded type of conformity, which may be unnatural, or offer very little flexibility.

The present disclosure provides a golf grip tool, with a primary focus on right-handed golfers. The golf grip tool could be applied to a left-handed golfer, by reversing the language that follows in the description (for example, 'right hand' is replaced by 'left hand', and vice versa). What follows is a description of a right-handed version of golf grip tool of the disclosure.

The golf grip tool includes a tapered, cylindrical object having a larger butt end and a narrower tip end, designed to be as close as possible in size and shape to a regulation U.S.G.A golf grip. The tool provides placement aids so that the fingers (especially of the left hand for right-handed golfers) may be placed on the club close to where they need to be. The golf grip tool provides, highlights, and identifies areas of the tool that are acceptable places for the placement of the fingers of both hands, utilizing a center line arrow on the topside of the tool and graphics for finger placement. The center line arrow is a visual aid for the golfer to ensure the tool is properly positioned in the golfer's hands and is needed if a golf club head is not attached to the tool.

For purposes of this application, the "underside" of the tool and grip is that portion closest to the ground when holding the tool in a normal swing position. The "topside" of the tool is that portion facing the sky in a normal swing position. Furthermore, the "top hand" is the hand that grips the tool or club at the butt end, and the "bottom hand" is the hand that grips the club below the top hand.

The tool insures the correct placement of the pinky of the top hand (the left hand for right-handed golfers) at a right angle (or very near) to that of the tool. An electric light button or a simple spring is included, insuring proper positioning of the top hand heel pad (the left hand for right-handed golfers) on or very near the top center of the grip at the butt end. The button or spring must be depressed correctly by the heel pad area of the left hand, giving immediate feedback to the player (visual or tactile), indicating this critical step of hand placement has been accomplished successfully.

FIGS. 1A-1D show two perspective views, as well as topside and underside views, of the present disclosed golf grip tool. The golf grip tool 100 is similar in size and form to a regulation size U.S.G.A golf grip, with added graphics 110 indicating proper placement of the hands. There is a hand placement indicator 120 near the butt end 130 of the handle, which includes a spring or electric light button, which when pressed with enough pressure, indicates correct hand heel pad placement. There is a reminder spline 140 mounted on the underside of the grip tool for reference to the joints of the fingers. Pinky stop 602 is a modest protrusion that encircles approximately half of the grip, starting where the spline ends.

In one embodiment, the hand placement indicator 120 consists of a button, which when depressed causes a light in butt end 130 to which it is electrically connected to glow. The button and light embodiment also requires a power source such as a small battery (not shown), and a cover over the light (preferably an LED-based light source) that is connected to the disclosed grip tool.

Figures 2A, 2B, 2C:
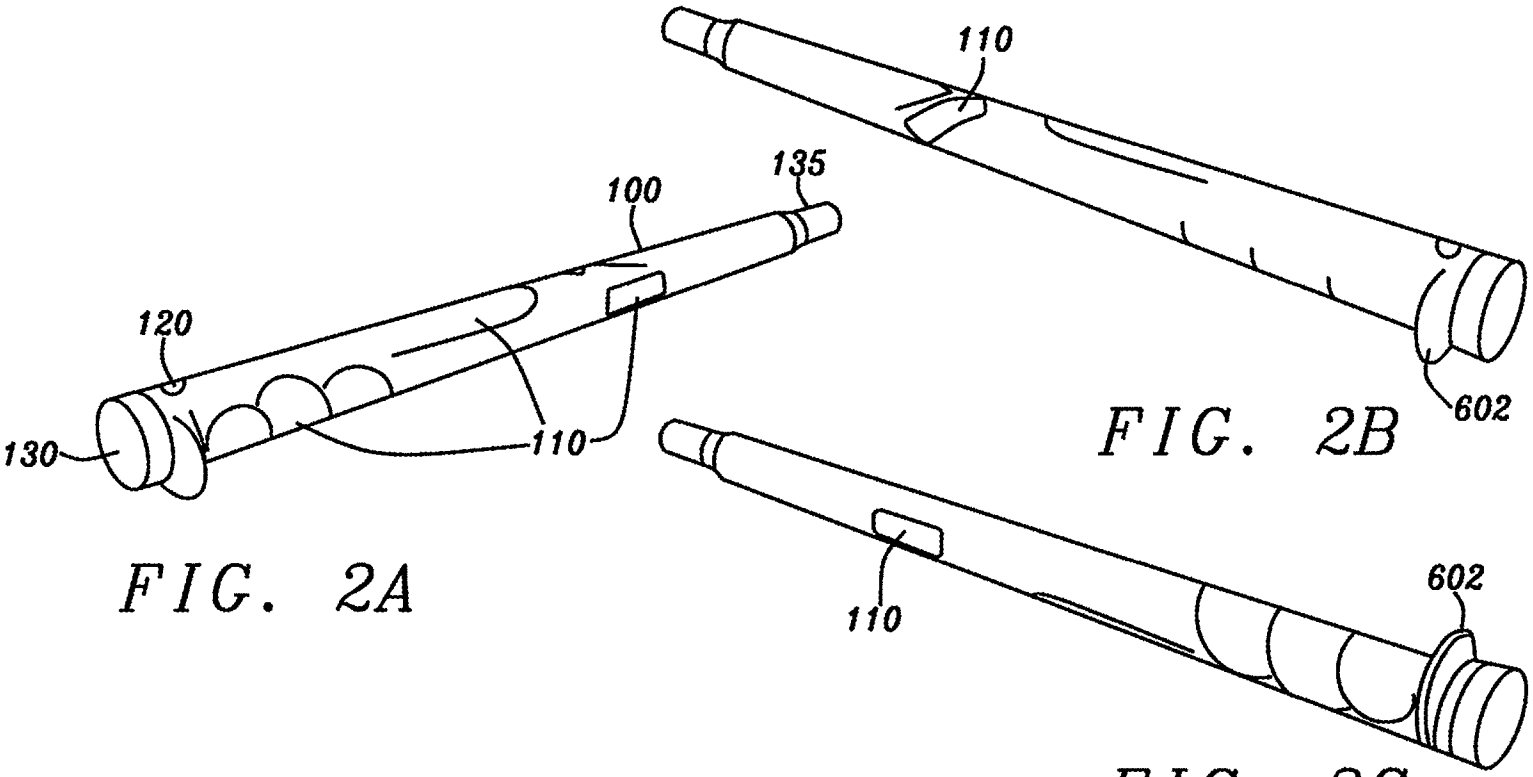
FIGS. 2A-2C show additional perspective views of the present disclosure.

FIGS. 2A-2C show additional perspective views of the present disclosure. Graphics 110, hand placement indicator 120, butt end 130, and tip end 135 are illustrated. The graphics include suggestions of where to place the thumbs and fingers of both hands.

Figure 3B:
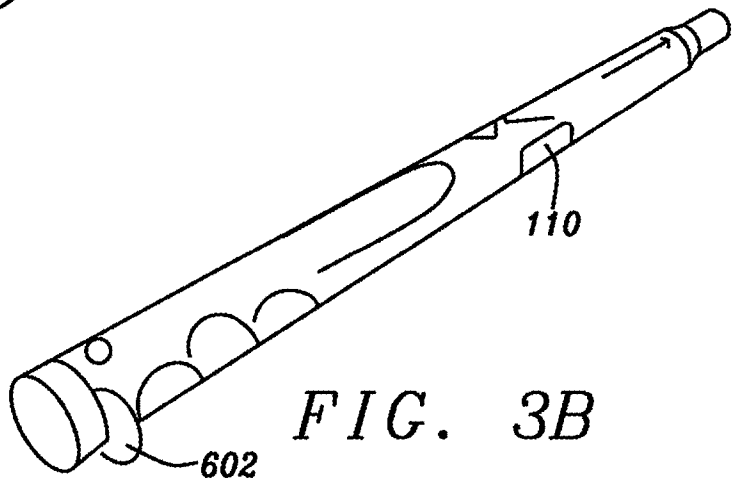
FIGS. 3A-3B show a button and light on the butt end (the thicker end) of a golf grip tool.
Figure 3A:
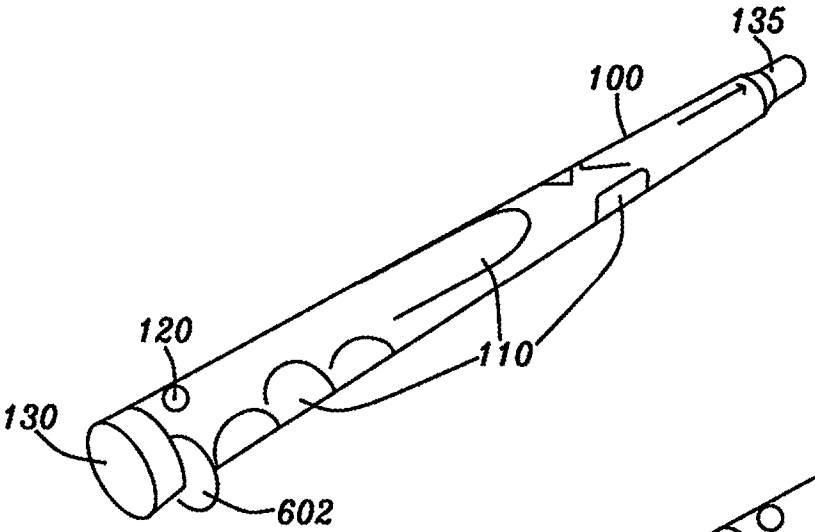
Figure 4A:
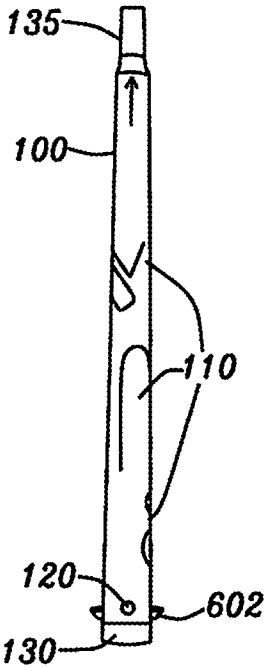
FIGS. 4A-4D show orthographic views from the topside, right side, underside, and left side, of the golf grip tool of the present disclosure.
Figure 4B:
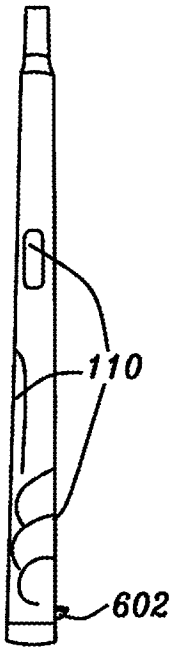
Figure 4C:
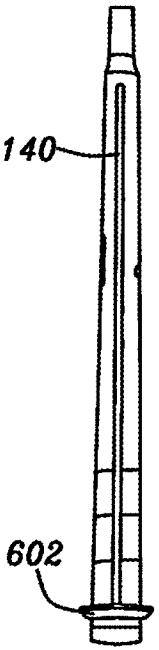
Figure 4D:
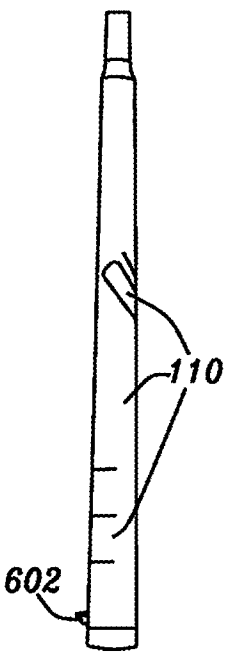
Figures 5A, 5B, 5C, 5D:
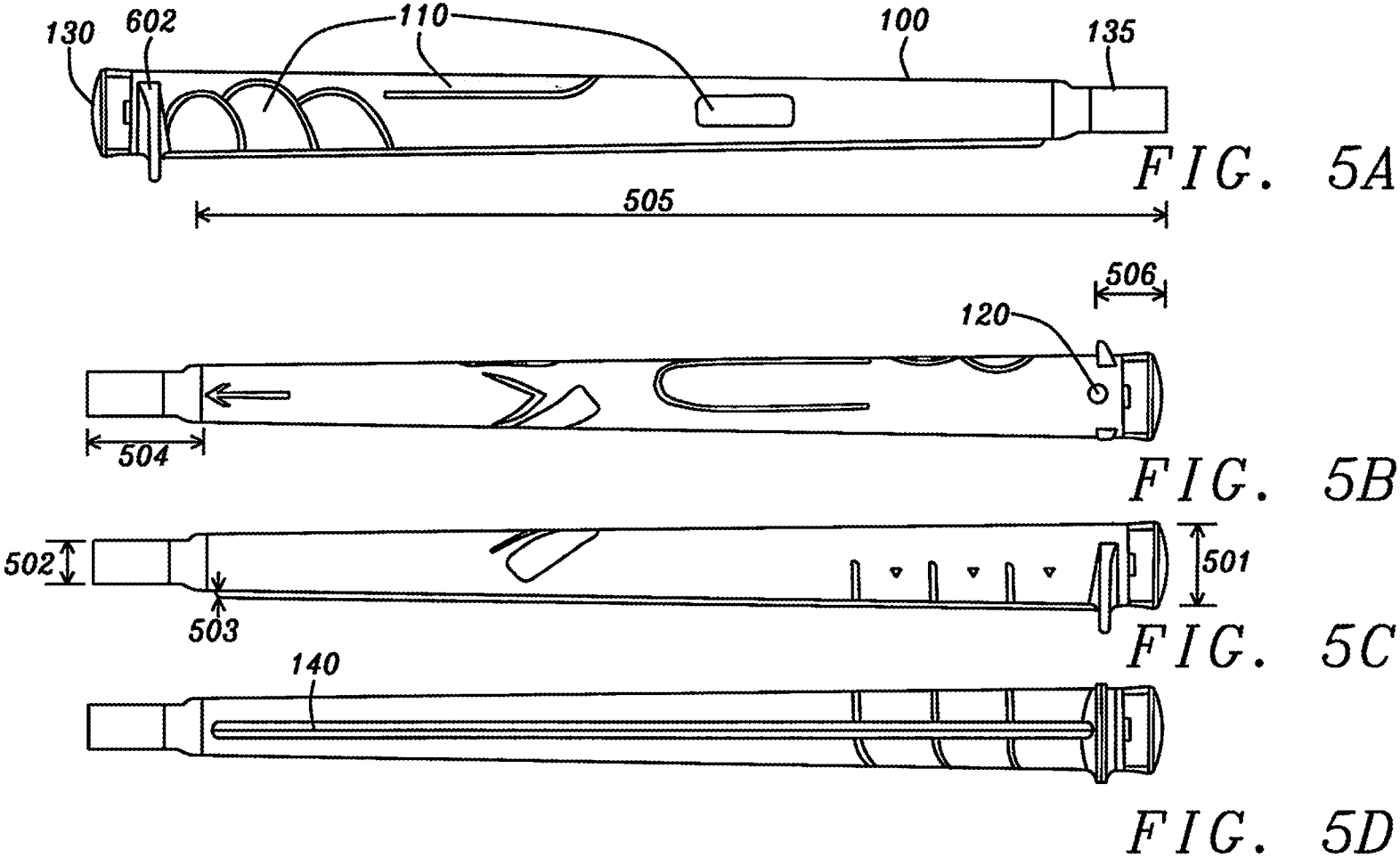
FIGS. 5A-5D show some typical dimensions of the golf grip tool.

FIGS. 3A-3B show, for example, an electric light button on the butt end of the golf grip tool. Pushing the hand placement indicator 120 down with enough pressure allows the butt end 130 to light up, indicating the foundation of a proper golf grip.

For the case on the electric light button, the pressure needed to activate the light should be at least 2-4 psi (pounds per square inch). The switch is activated by approximately this amount of pressure. The main purpose of the switch and light is not so much to measure or evaluate grip strength, but more to insure proper positioning of the user's upper hand on the grip.

FIGS. 4A-4D show orthographic views from the topside, right side, underside, and left side, respectively. Graphics 110, hand placement indicator 120, butt end 130, and tip end 135 are illustrated, as well as reminder spline 140 for finger placement, mounted on its underside, and pinky stop 602.

FIGS. 5A-5D show some typical dimensions of the golf grip tool. The butt end circumference 501 is, for example, 1" and the tip end circumference 502 is, for example, ½". It has a round rib or spline 140 referred to as the finger placement guide, dead center on the underside, running almost the entire length of the tool. The spline diameter 503 is, for example, ⅛". The tip end has an extension 504 from the grip portion of, for example, 1½" to simulate a portion of a golf club shaft. The length 505 of the grip portion of the tool is, for example, 11" including the butt end cap. (The diameter of the butt end cap is, for example, ⅜"). The hand placement indicator 120 is centered 506 on the topside of the grip, for example, 1½" from the outside surface of the butt end of the tool.

The grip tool provides graphics 110 for the approximate placement of the left thumb, the last 3 fingers of the left hand, and the inside portion of the right thumb and right pointer finger pad. It also includes a highlighted center line, for example, 3" long, located on the topside center of the grip tool, pointing away from the player to depict the center at the tip end of the tool.

Figures 6A, 6B, 6C:
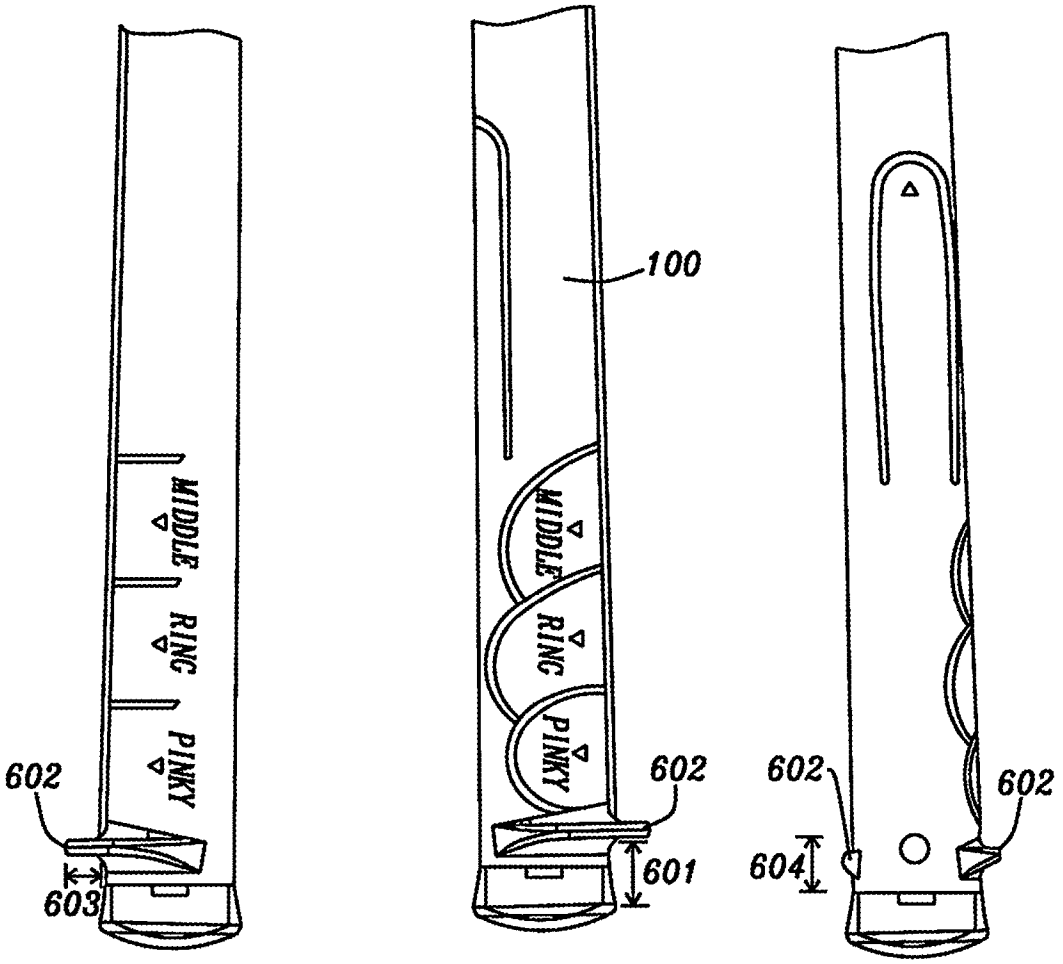
FIGS. 6A-6C show the pinky stop, which ensures the proper placement of the left hand pinky, of the present disclosure.

FIGS. 6A-6C show the pinky stop, which ensures the proper placement of the left hand pinky, of the present disclosure. At the butt end of the golf grip tool, for example, 1" 601 up from the end, there is pinky stop 602, a modest protrusion of, for example, ¼" 603 that encircles approximately half of the grip, starting where the spline ends. It is located at a right angle (90 degrees) to the grip and travels in a half circle around the underside of the grip. The protrusion encompasses, for example, ¼" 604 of the surface of the grip tool. The pinky stop ensures proper placement of the left hand for a right-handed golfer.

The golf grip tool of the present disclosure is shaped and sized as closely as possible to a genuine golf grip so that transference of what is learned is simple, effortless, and correct. The tool will be marketed with a QR code to provide users with in-depth information and the opportunity for interaction and questions with the inventor, or a golf teaching professional.

Figure 7B:
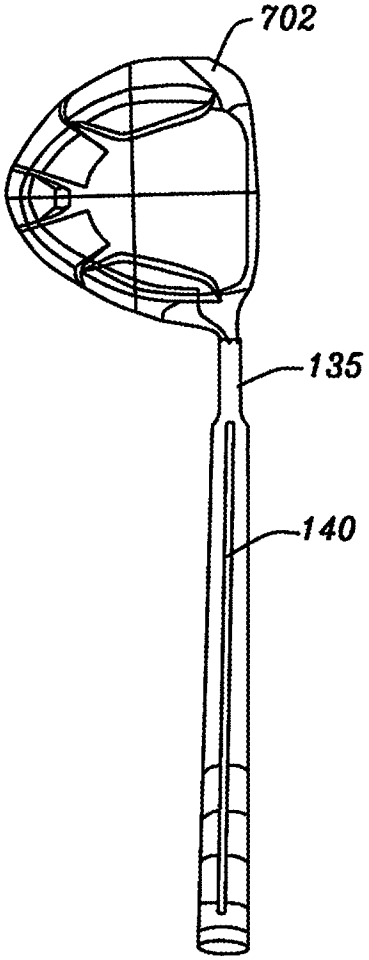
FIGS. 7A-7B show topside and underside perspectives, where a club head is added to the golf grip tool.
Figure 7A:
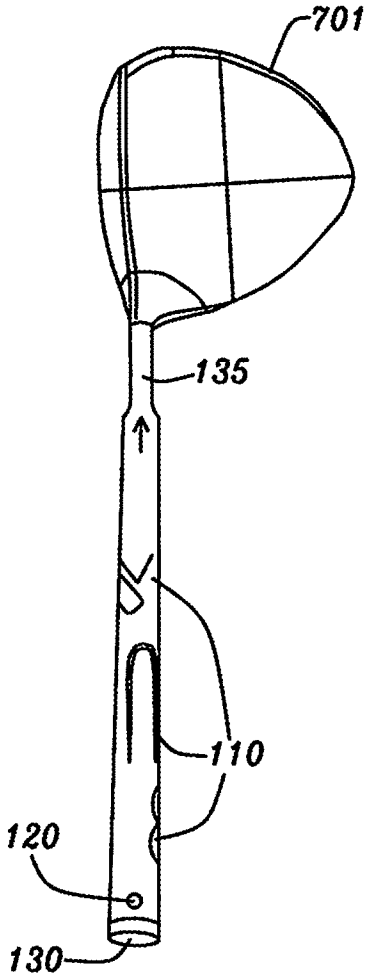

FIGS. 7A-7B show topside 701 and underside 702 perspectives, where a club head is added to create a tool that can stand up on a desk or any hard, flat surface. The addition of the club head at the end of the tool is not intended to turn the tool into a full-length golf club. Instead, the club head is mounted near the tip end of the tool for the user to see the desired relationship between their grip and the club head face.

Figure 8A:
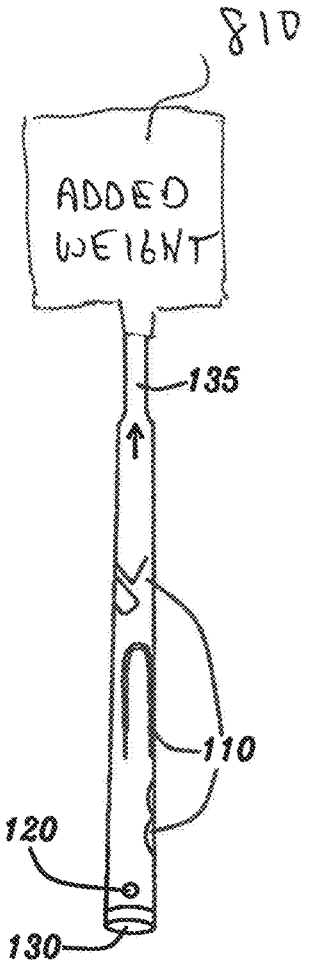
FIGS. 8A-8D show an added weight, lighted club head, and simple spring, of the disclosed golf grip tool.
Figure 8B:
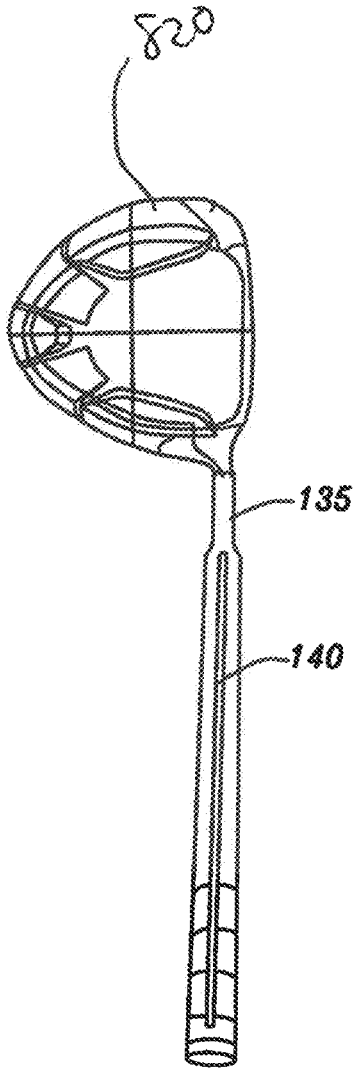

More weight 810, as shown in FIG. 8A, on the tip end of the tool might be considered, and the lighted portion of the club may be switched to the head—shown as lighted head 820 in FIG. 8B—with the button remaining where it is illustrated in the figures. The color of the grip or tool may vary, and combinations include charcoal with yellow, green, blue, red, or grey, or other colors to be determined.

Figure 8C:
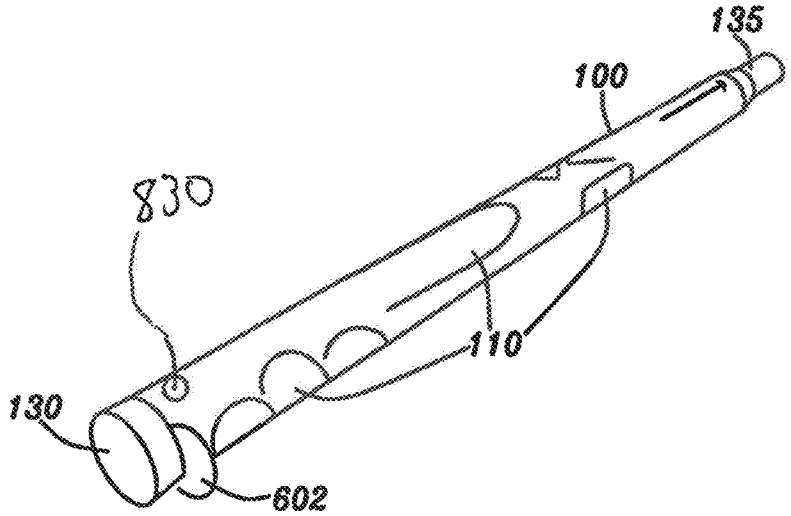
Figure 8D:
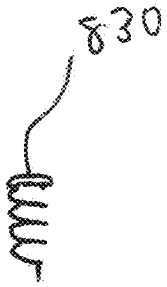

One variation, as an alternative to the light button, includes a simple spring 830, as shown in FIGS. 8C and 8D, embedded in the tool and protruding out by, for example, ¼", at the butt end location where the button would be. The main purpose of the spring is for correct placement of a person's hand on the grip. In the case of the spring, the correct part of the hand heel pad would need to be positioned directly over the spring to push it straight down and not from one side or the other. Feedback would be tactile, rather than visual, as in the case of the electric light button.

The main advantage of one or more embodiments of the present disclosure includes providing a golf grip tool very closely resembling a U.S.G.A. approved golf grip. The golf grip tool allows for minor variances in all areas of the grip and provides a button light, or spring, for interaction and immediate feedback to the player. The golf grip tool may also be used without a club. In this way, a personal golf grip may be learned faster and more permanently, allowing the tool to be taken to any location with ease.

While particular embodiments of the present disclosure have been illustrated and described, it will be understood by those skilled in the art that various changes in form and details may be made without departing from the spirit and scope of the invention.

What is claimed is:

1. A golf grip tool, comprising:

a cylindrical device tapered from a larger butt end to a narrower tip end; and a simple spring embedded in the golf grip tool at the butt end, on or very near the top center of the grip, configured to be pushed straight down, and not from one side or the other, with pressure of a hand heel pad directly over the simple spring, with enough pressure to give immediate feedback to a player indicating hand placement has been accomplished successfully, wherein the golf grip tool is used without a golf club.

2. The golf grip tool of claim 1, further comprising graphics which describe where to place the thumbs and fingers of both hands.

3. The golf grip tool of claim 2, wherein the graphics include a highlighted arrow line located on a topside of a golf grip, pointing away from a user.

4. The golf grip tool of claim 1, wherein the golf grip tool is shaped and sized similar to a U.S.G.A. approved golf grip.

5. The golf grip tool of claim 1, wherein a weight is added to the tip end of the tool offering resistance.

6. The golf grip tool of claim 1, wherein the golf grip tool further comprises a club head added to the golf grip tool, mounted at the tip end of the golf grip tool.

7. The golf grip tool of claim 6, wherein the club head is configured to light up.

8. The golf grip tool of claim 3, further comprising an extension from tip end of the golf grip, to simulate an upper end of a golf club shaft.

9. The golf grip tool of claim 1, wherein a finger placement spline is located on an underside of the cylindrical device, running approximately a length of the golf grip tool.

10. The golf grip tool of claim 1, further comprising a pinky stop, comprising a protrusion that encircles a portion of the grip tool, starting near to where a finger placement spline on the underside ends at the butt end, located at about a right angle to the grip tool, and located on the underside of the grip tool.

* * * * *